US008869407B2

(12) United States Patent
Votolato

(10) Patent No.: US 8,869,407 B2
(45) Date of Patent: Oct. 28, 2014

(54) MULTI-BLADE BAG CUTTER

(75) Inventor: Earl Votolato, Newport Beach, CA (US)

(73) Assignee: The Votolato Living Trust, Newport Beach, CA (US)

( * ) Notice: Subject to any disclaimer, the term of this patent is extended or adjusted under 35 U.S.C. 154(b) by 177 days.

(21) Appl. No.: 13/546,212

(22) Filed: Jul. 11, 2012

(65) Prior Publication Data

US 2014/0013604 A1 Jan. 16, 2014

Related U.S. Application Data

(63) Continuation-in-part of application No. 13/528,473, filed on Jun. 20, 2012.

(51) Int. Cl.
*B26B 3/00* (2006.01)
*B67B 7/00* (2006.01)

(52) U.S. Cl.
USPC ..... 30/294; 30/280

(58) Field of Classification Search
CPC ..... B67B 7/30; B26B 27/005; B26B 3/00
USPC ..... 30/2, 123, 142, 175, 186, 294, 299
See application file for complete search history.

(56) References Cited

U.S. PATENT DOCUMENTS

| | | | | |
|---|---|---|---|---|
| 1,082,400 | A | 12/1913 | Burnite | |
| 1,216,899 | A | 2/1917 | Weyer | |
| 1,963,564 | A * | 6/1934 | Smith et al. | 30/186 |
| 2,033,050 | A | 3/1936 | Pankonin | |
| 2,233,497 | A * | 3/1941 | Teigen | 30/289 |
| 2,389,648 | A * | 11/1945 | Stafford | 30/151 |
| 2,593,601 | A * | 4/1952 | Pollak | 30/2 |
| 2,649,656 | A | 8/1953 | Hedrick | |
| 2,674,796 | A * | 4/1954 | Herold | 30/262 |
| 2,681,504 | A * | 6/1954 | Fox | 30/123 |
| 2,881,520 | A | 4/1959 | Mito | |
| 3,047,947 | A * | 8/1962 | Spenninger | 30/186 |
| 3,142,426 | A | 7/1964 | Busse | |
| 3,727,272 | A | 4/1973 | Rhodes | |
| 3,883,953 | A * | 5/1975 | Saullo et al. | 30/304 |
| D235,306 | S | 6/1975 | Christian et al. | |
| D256,883 | S | 9/1980 | Wharmby | |
| 4,455,894 | A * | 6/1984 | Roberts | 81/3.09 |
| D276,786 | S | 12/1984 | Chen | |
| 4,530,154 | A | 7/1985 | DiCarlo | |
| 4,581,823 | A | 4/1986 | Gilman | |
| 4,711,031 | A | 12/1987 | Annello | |
| D298,210 | S | 10/1988 | Hutson et al. | |

(Continued)

FOREIGN PATENT DOCUMENTS

| | | |
|---|---|---|
| CA | 2 468 050 | * 11/2005 |
| GB | 1 455 919 | * 11/1976 |

(Continued)

*Primary Examiner* — Hwei C Payer
(74) *Attorney, Agent, or Firm* — Fish & Tsang LLP

(57) ABSTRACT

A multi-blade bag cutting apparatus for opening a sealed package using one of at least two methods has a first arm partially enclosing a first blade and a first or second arm having a cutout exposing a second blade. The two arms can be injection molded as a single piece of plastic or comprise two separate pieces coupled to a pivot. Preferably, the first blade is partially juxtaposable against a cutting surface, which can be, among other things, a raised portion and/or an anvil.

31 Claims, 11 Drawing Sheets

(56) References Cited

U.S. PATENT DOCUMENTS

| | | | | |
|---|---|---|---|---|
| 4,887,355 | A | 12/1989 | Colbert | |
| 5,007,171 | A | 4/1991 | Horning, Jr. | |
| 5,044,081 | A * | 9/1991 | Nguyen | 30/294 |
| 5,103,562 | A * | 4/1992 | Braatz | 30/294 |
| 5,357,679 | A * | 10/1994 | Hanna | 30/294 |
| 5,524,348 | A * | 6/1996 | Tipp | 30/294 |
| 5,561,905 | A * | 10/1996 | Sherman | 30/280 |
| D419,417 | S | 1/2000 | Kane | |
| 6,629,327 | B2 * | 10/2003 | Adams | 7/158 |
| 6,658,742 | B2 | 12/2003 | Votolato | |
| 6,857,192 | B1 * | 2/2005 | Summers et al. | 30/294 |
| 6,966,244 | B2 * | 11/2005 | Herbst et al. | 81/418 |
| 7,073,264 | B2 | 7/2006 | Votolato | |
| D542,104 | S | 5/2007 | Holcomb et al. | |
| 7,506,445 | B2 | 3/2009 | Buyse et al. | |
| 7,891,100 | B2 | 2/2011 | Gelardi et al. | |
| D636,248 | S * | 4/2011 | Still | D8/98 |
| 7,958,639 | B2 * | 6/2011 | Ireland | 30/2 |
| 2002/0026711 | A1 * | 3/2002 | Edwards et al. | 30/90.1 |
| 2005/0102844 | A1 | 5/2005 | Addis | |
| 2006/0196018 | A1 | 9/2006 | Taylor et al. | |
| 2008/0134517 | A1 * | 6/2008 | Bosworth et al. | 30/114 |
| 2011/0030145 | A1 * | 2/2011 | Mandic | 7/107 |
| 2013/0340262 | A1 * | 12/2013 | Votolato | 30/142 |
| 2013/0340263 | A1 * | 12/2013 | Votolato | 30/186 |
| 2014/0013604 | A1 * | 1/2014 | Votolato | 30/142 |

FOREIGN PATENT DOCUMENTS

| | | |
|---|---|---|
| GB | 2234699 | 2/1991 |
| JP | 2000-279659 | 10/2000 |
| WO | 2008/086101 | 7/2008 |

* cited by examiner

MULTI-BLADE BAG CUTTER

This application is a continuation-in-part of U.S. patent application Ser. No. 13/528,473, filed Jun. 20, 2012, which is incorporated herein by reference in its entirety.

FIELD OF THE INVENTION

The field of the invention is bag cutters.

BACKGROUND

Employment of sealed bags for housing various products is a well-accepted packaging approach. While such bags are highly desirable for their efficiency in maintaining product integrity, access into the contents of such bags is often inconvenient, and contents often spill due to messy cuts and tears.

Various bag cutters are available that attempt to overcome some of the problems described above. Such cutters include the devices described in International Patent Application Publication No. 2008/086101, United States Patent Publication No. 2005/0102844, and U.S. Pat. Nos. 7,073,264, 6,658,742, 4,887,355, and 5,007,171.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

The following background discussion includes information that may be useful in understanding the present invention. It is not an admission that any of the information provided herein is prior art or relevant to the presently claimed invention, or that any publication specifically or implicitly referenced is prior art.

Existing bag cutters are not necessarily as versatile, durable, or safe as could be desired. Thus, there is still a need for improved cutting devices.

SUMMARY OF THE INVENTION

The inventive subject matter provides apparatus, systems and methods for cutting various objects, especially plastic bags, using a dual cutting device having a first cutter with a first blade and a second cutter with a second blade. The first blade preferably operates in conjunction with a movable arm.

Preferred bag cutters generally have two arms, which can advantageously be injection molded as a single, continuous piece of plastic. Alternatively, the arms can be two discontinuous pieces of material coupled to a pivot.

The cutting surface(s) can be distributed on one or both arms in any suitable fashion. For example, one arm can partially enclose a first blade, while the other arm can have a cutting surface that is at least partially juxtaposable against the first blade. Also contemplated are embodiments having one or more blades extending into one or more cutouts.

As used herein, a "cutting surface" means any surface that could be used in conjunction with a blade to create a cut. Contemplated cutting surfaces include, among other things, a recessed portion of an arm, a raised portion of an arm, and/or an anvil. A "raised portion" could be continuous with an arm or be a separate piece of material coupled to an arm. Where a different type and/or separate piece of material is used as a raised portion, it is contemplated that the material could be harder, equal to, or softer in hardness to the material of one or more of the arms. Suitable raised portion materials include any and all materials suitable for any other portion of a cutting apparatus as described herein. Suitable anvils will typically have a convex surface, as for example in a cylinder or cone, and could even have a compound convex surface as in a ball.

Bag cutters can have one, two, or even more blades, anvils and raised portions. For example, a cutting apparatus could have three blades, no anvil, and four raised portions. In such a configuration, each blade can be used to make a cut in a work piece in conjunction with one or two of the four raised portions, or two of the blade can be used to make two cuts in conjunction with the raised portions with a third blade exposed by a cutout configured to create an optional separate cut. Where there are an unequal number of blades and cutting surfaces, the extra piece(s) will typically provide either a deeper cut, or a strip cut.

Contemplated blades can have any suitable edge that mates with the anvil or other cutting surface, and can have flat, concave or convex edges. Blades can be made of any suitable material, including steel, ceramic, and plastic. Blades made with one or more non-optimal materials can optionally have suitable coatings, including for example Teflon™ or other friction-reducing coating, and metal coatings or other corrosion-resistance coatings. Stops can be included to control cutting depth. Each blade is preferably embedded in such a way that at least a portion of an edge of a blade is exposed at all times (as shown in FIGS. 1-3, and 5-9).

Also contemplated is a tab coupled to an arm or pivot, the tab having a hole configured to accept a hanger. Still further it is contemplated for a bag cutter to have various safety features, including, for example, a locking strap, and a ridge in one or both of the arms to help prevent a user's fingers from sliding off the arm.

Contemplated devices could typically be used in at least two ways: (1) placing a bag between a cutting surface and a blade and squeezing the arms while sliding across the bag; and (2) sliding a bag through a cutout exposing a blade.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
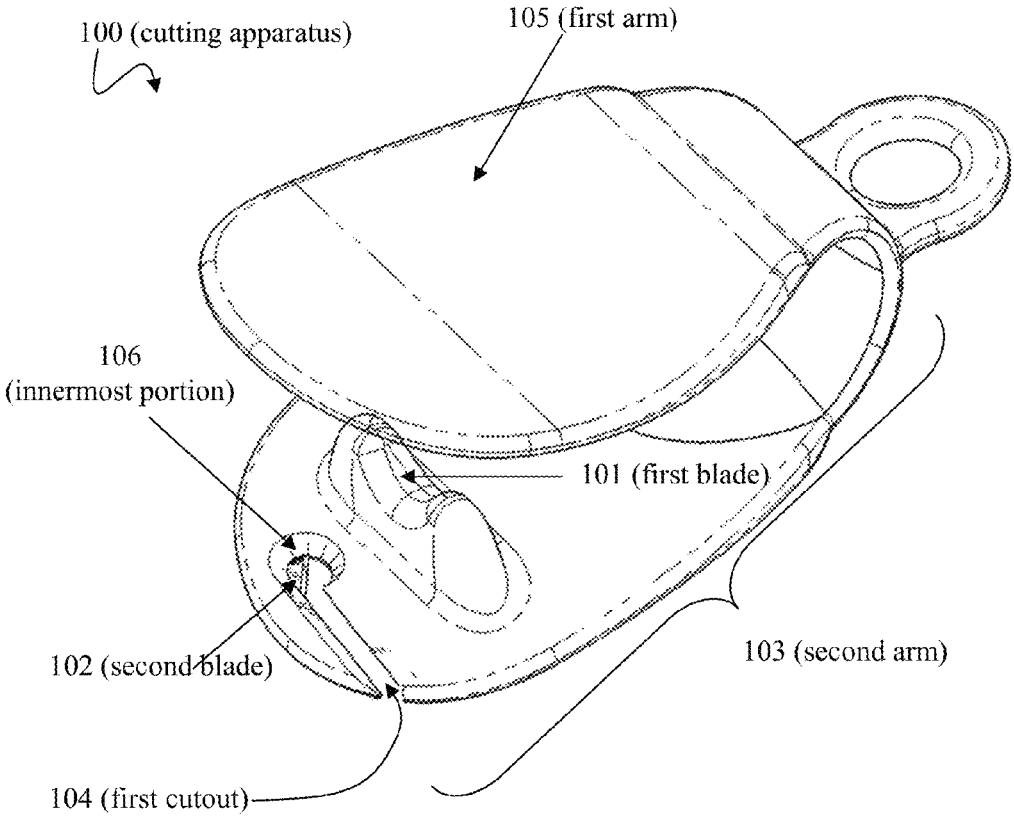
FIG. 1 is a top-perspective view of a cutting apparatus.

In FIG. 1, a cutting apparatus 100 generally has a first blade 101 and second blade 102. One arm, e.g., the second arm 103, has a cutout 104 exposing the second blade 102. First blade 101 is preferably partially embedded in an arm (103 or 105) for added rigidity, but can also be embedded in an extra piece of material (not shown) that is coupled to an arm. Second blade 102 can be partially exposed from any portion of cutout 104, but is preferably exposed from an innermost portion 106. First and second arms 105 and 103 are bendable and preferably configured so that an interior portion of first arm 105 can juxtapose an interior portion of second arm 103.

As described herein, a blade that is partially or completely "embedded" in an arm can either be embedded in (1) the material of the arm itself, or (2) a separate piece of material that is directly coupled to the arm. Thus, a blade, e.g. 101, can be described as "partially embedded in second arm", even if it is only directly embedded in a visually distinct piece of material directly coupled to the first arm. Where a blade(s) is embedded in a separate piece of material, it is contemplated that the separate piece of material could be rotatably and/or slidably coupled to an arm so that the location of the blade(s) and the orientation of the blade relative to a midline could be adjusted. The same coupling options apply to anvils, raised portions, and so forth.

The first and second arms and of a cutting apparatus could comprise a single continuous piece of material, or could comprise two or more separate pieces of material. Contemplated materials include metals and steel. However, preferred materials include various types of plastics, such as acrylics, polyesters, silicones, polyurethanes, halogenated plastics, and all materials or polymers having sufficient flexibility to bend and sufficient rigidity to maintain the overall shape of the apparatus during repeated use.

The first blade 101 is preferably juxtaposable against a cutting surface (not shown). It is contemplated that the edge of the blade could be flat, concave, or convex at juxtaposition with the cutting surface. The blade could be made of any suitable material or materials, including for example, a steel, a plastic, a ceramic, a bronze, a copper, or any combination thereof.

Figure 2:
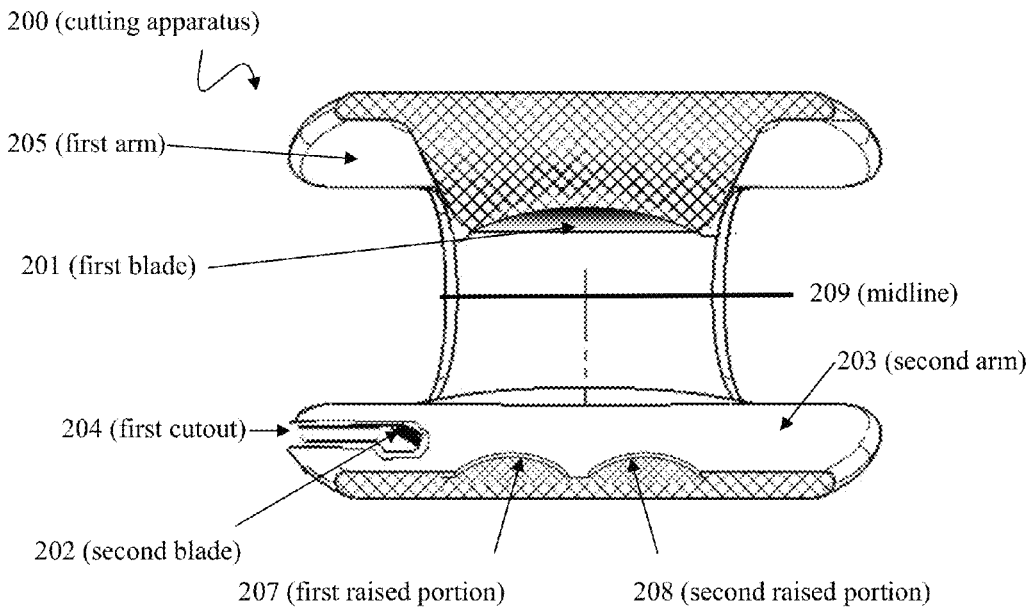
FIG. 2 is a front view of a cutting apparatus having two raised portions.

In FIG. 2, a cutting apparatus 200 has a first blade 201 partially embedded in first arm 205 at least partially juxtaposable against first raised portion 207 and/or second raised portion 208 on second arm 203. It is also contemplated that an apparatus can comprise zero, one, three, or even more raised portions. A bag or other object (not shown) can be placed in between the first blade and the first and second raised portions and, which are pressed together such that the bag object is cut by the blade and first raised portion, followed by the blade and second raised portion. In this way, two or more raised portions can be used to provide a deeper cut.

Cutting apparatus 200 includes a second blade 202 extending from a portion of a first cutout 204. A blade and the cutout from which it extends can be located on any part of first arm or second arm, including the midline, e.g., 209 of a cutting apparatus, where the first and second arms are made of a single piece of material.

It is contemplated that first blade 201 can be positioned at any angle relative to midline 209 of the cutting apparatus 200. For example, the first blade and raised portions can be parallel to a midline, perpendicular to the midline, or positioned at any angle in between.

It is contemplated that each of the blades, raised portions, anvils, and cutouts can be located on any portion of any arm. As used herein, the term "raised" with respect to a component means that a portion of the raised component is elevated above an adjacent surface or edge by at least 1 mm, and more preferably by at least 4 mm, and more preferably by at least 7 mm.

One possible cutting surface is an anvil (not shown). As used herein, an "anvil" is any separate piece of a hard material or materials that is at least partially inserted into and/or molded into at least one of an arm (e.g., 205 or 203) or a raised portion (e.g., 207 or 208) of the cutting apparatus. An anvil can be of any suitable size and shape, including for example, a blade, a ball, a compound convex surface, a cylinder, a cone, or any other suitable shape. An anvil could be made of any suitable material or materials, such as steel, plastic, ceramic, bronze, copper, or any combination of those or other materials having sufficient hardness and durability to act as a cutting surface for a blade. It is contemplated that an exposed portion of an anvil could comprise a different material than other portions of the anvil. Any and all portions of an anvil could comprise a material that is harder, of the same hardness, or softer than the material used on an arm to which it is coupled. It is further contemplated that an anvil could comprise the same material as an arm to which it is coupled.

Figure 3:
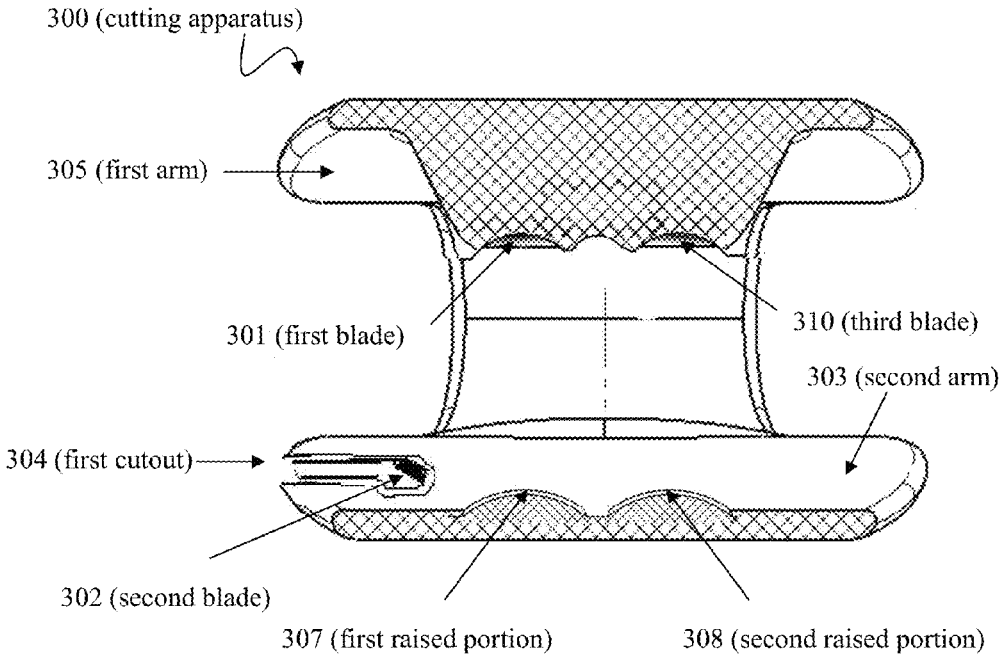
FIG. 3 is a front view of a cutting apparatus having three blades, one cutout, and two raised portions.

In another embodiment as illustrated in FIG. 3, a cutting apparatus 300 has three blades, two of which are juxtaposable against cutting surfaces, and the third extends into a cutout.

First arm 305 has a first blade 301 at least partially juxtaposable against a first raised portion 307, and a third blade 310 at least partially juxtaposable against a second raised portion 308. The first blade 301 and third blade 310, and thus the first and second raised portions 307 and 308, can be aligned end to end (as in FIG. 3), side by side (not shown), or at any alignment in between. First and third blades 301, 310 can be aligned in an end to end manner to provide a deeper cut, and can be aligned in a side by side manner to provide a strip cut.

The first and third blades (e.g., 301 and 310) can be partially embedded into a separate piece or pieces of material slidably coupled to the first or second arms. In such embodiments, the first and third blades could move relative to one another to provide deeper cuts and a variety of strip cuts of different widths. Moreover, the first and second raised portions could be slidably coupled to the opposite arm.

It is contemplated that the first raised portion and second raised portion could be of the same size and shape as one another, or be of different sizes and shapes, relative to one another. Moreover, it is contemplated that the first and third blades could protrude out away from an arm at a same distance, or protrude out at different distances.

Either of the first arm and/or second arm can serve as a base. For example, a first arm could comprise a first blade and a second raised portion, while a second arm comprises a third blade and a first raised portion. The first blade of first arm could provide a cut in conjunction with a first raised portion on second arm acting as a base, while the third blade of second arm could provide a cut in conjunction with a second raised portion on first arm acting as a base. One or more of the arms, e.g. second arm 303, can have a first cutout 304 and second blade 302 to provide an alternative cutter.

Figure 4:
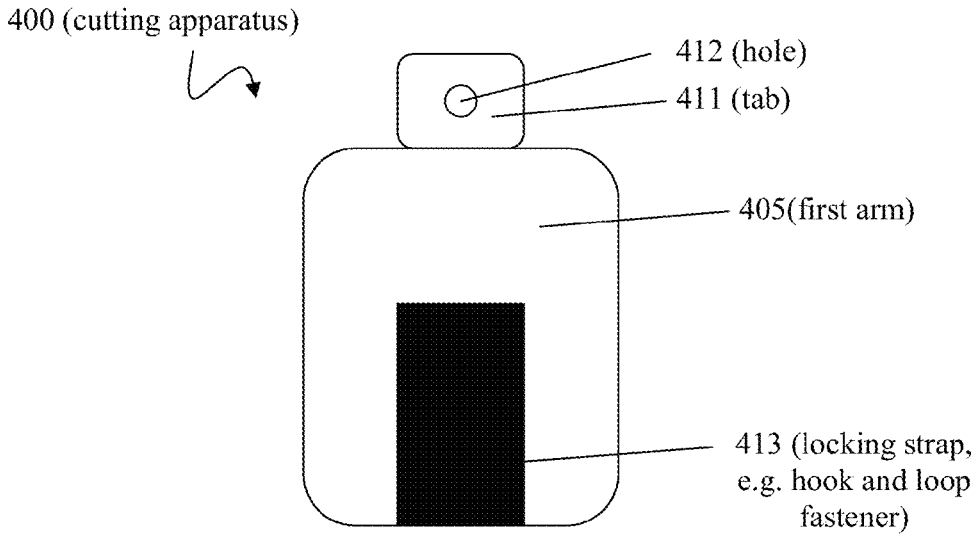
FIG. 4 is a top view of a cutting apparatus having a locking strap.

In FIG. 4, a cutting apparatus 400 has a tab 411 with a hole 412 configured to accept a hanger for convenient display or storage. Such a hole could be located on any portion(s) of a cutting apparatus (e.g. 400), with or without a separate tab (e.g. 411). A device in accordance with the inventive subject matter can also have a locking strap, e.g. 413, configured to keep the apparatus in a first position so that a portion of a first blade directly contacts a cutting surface. Apparatus 400 has a locking strap 413 removably or non-removably attached to one arm, e.g. the second arm (not shown), configured to wrap around a portion of both arms and removably attach to another arm, e.g. the first arm 405. The locking strap could be made of any material or materials, including for example, a nylon, a cotton, a leather, and/or any other suitable material with sufficient flexibility to wrap around a portion of a cutting apparatus. It is contemplated that the mechanism used to removably attach the locking strap to an arm could comprise a hook and loop fastener, a button, a clip, a slider, or any other suitable mechanism that allows a user to repeatedly remove and attach the locking strap from the remaining arm.

Figure 5:
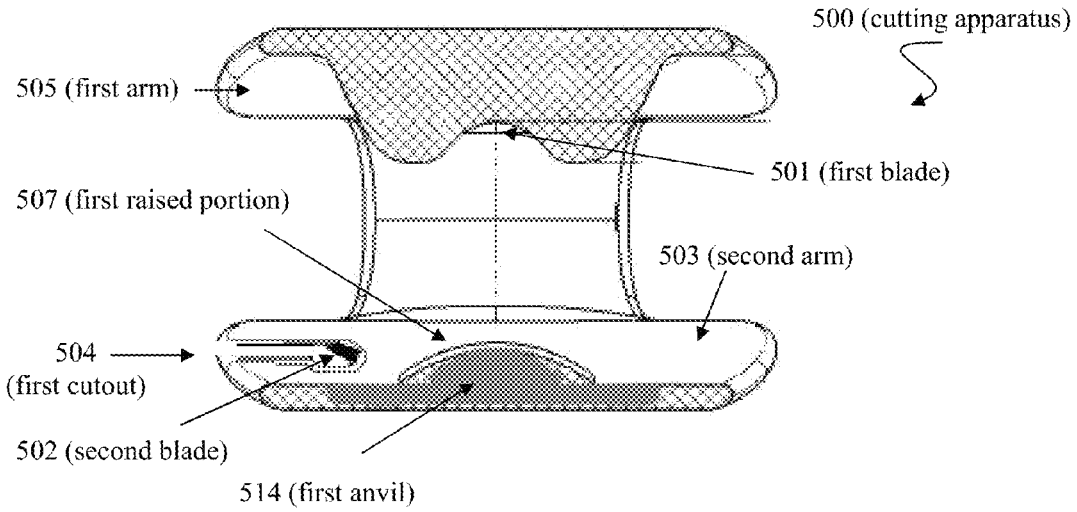
FIG. 5 is a front view of a cutting apparatus having a fully embedded anvil.

In FIG. 5, cutting apparatus 500 comprises an anvil 514 completely embedded within first raised portion 507. Apparatus 500 has a first blade 501 partially embedded in first arm 505. At least a portion of the edge of blade 501 is juxtaposable against raised portion 507, which completely embeds first anvil 514. First cutout 504 exposing a second blade 502 is preferably located behind raised portion 507 as shown in FIG. 5, but can also be located, among other places, in front of a raised portion. Thus, the first blade and corresponding cutting surface, if any, do not need to be located along the front edges of the apparatus.

Because the anvil 514 is initially completely embedded within first raised portion 507, first raised portion 507 can initially act as the sole cutting surface. With repeated use, anvil 514 could become exposed to an extent that the anvil, either alone, or with the cutting surface, acts as a cutting surface.

Each part of a cutting apparatus, e.g. first arm, second arm, blades, raised portion, and anvil, could comprise any suitable shape and be of any suitable size. Nevertheless, in preferred embodiments the entire cutting apparatus could easily be held and operated using a single hand.

It is contemplated that anvil 514 could comprise a through-hole (not shown) that is configured to mate with an internally facing detect in a raised portion or arm to hold the anvil 514 in place. Where the anvil is has a length that is at least twice as long as a width (e.g. rectangular block, blade, etc.) it is contemplated that the long axis of an anvil can be disposed orthogonal to the long axis of a blade, thereby reducing the size of the cut made. Alternatively, the long axis of an anvil can be parallel or diagonal to, the long axis of the blade. It is further contemplated that anvil 514 can be rotatable, either alone, or along with a piece of a raised portion, thereby allowing a user to switch the size of the cut(s) made by the cutting apparatus 500.

In preferred embodiments, the anvil, e.g. 514 is removable and/or replaceable with another anvil (not shown) to provide durability. The replacement anvil could either be the same type (material and/or shape) as the existing anvil, e.g. 514, or a different type of anvil. Alternatively, an anvil could be permanently embedded into a raised portion of the cutting apparatus.

A cutting apparatus can have one or more anvils embedded (each partially or completely) into an arm and/or raised portion(s). For example, an apparatus can have a single anvil that is embedded in two or more raised portions, a single anvil embedded into both an arm and an attached raised portion, a single anvil embedded into an arm without a raised portion, or even have a single anvil embedded in one raised portion and a separate anvil embedded in another raised portion.

Figure 6:
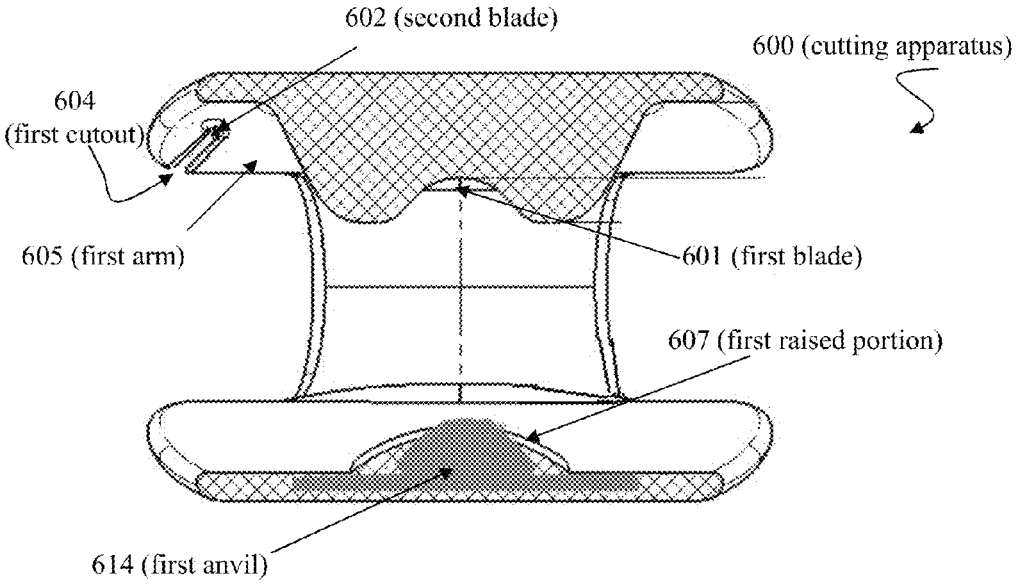
FIG. 6 is a front view of a cutting apparatus having a partially embedded anvil.

In FIG. 6, cutting apparatus 600 comprises an anvil 614 only partially embedded within first raised portion 607. First arm 605 comprises both the first blade 601, partially embedded therein, and first cutout 604 exposing a second blade 602.

Cutout(s) can have any suitable dimensions, but are preferably long and narrow to receive a bag or other thin object being cut. As used herein, the terms (a) "a cutout having a blade", (b) "a blade extending from a cutout", and (c) "a cutout exposing a blade" are all used interchangeably.

Figure 7A:
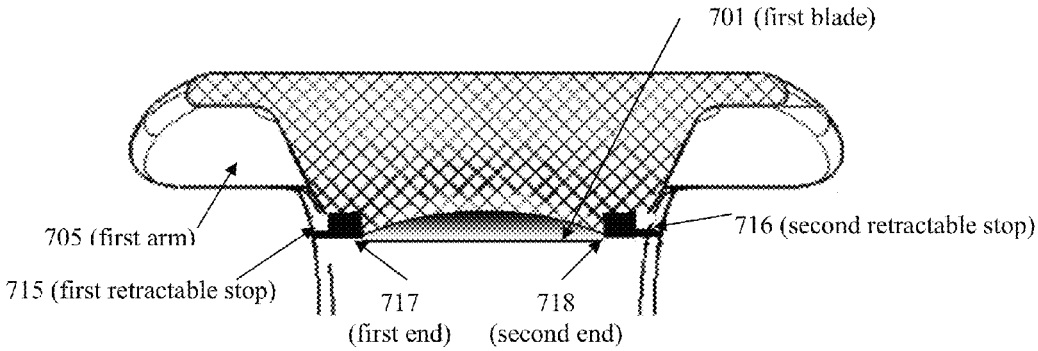
FIG. 7A is a partial front view of a cutting apparatus having retractable stops.
Figure 7B:
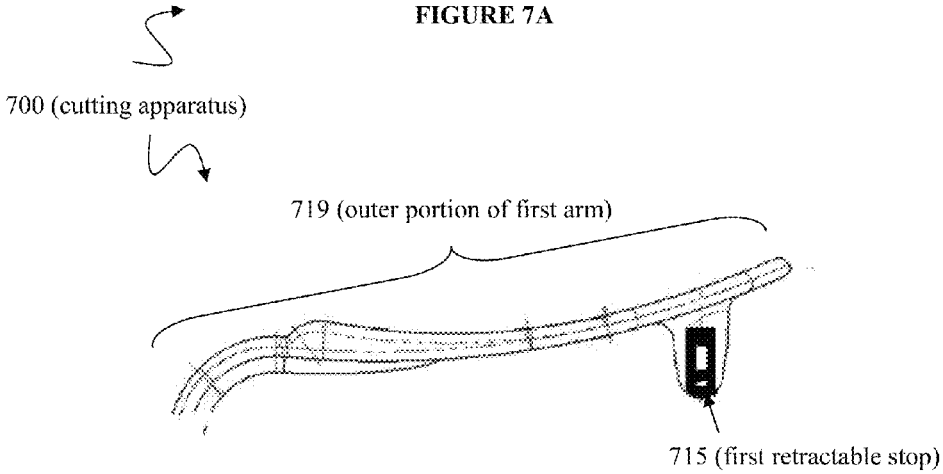
FIG. 7B is a partial side view of a cutting apparatus having a retractable stop.

In FIGS. 7A-B, a portion of the first arm 705 that surrounds the first blade 701 comprises a first and second retractable stop, 715 and 716 respectively. Such retractable stops 715 and 716 could be used to increase and/or decrease the depth of the blade 701 that is exposed at first and second ends, 717 and 718 respectively. Such embodiments allow a user to control the depth of a cut made by cutting apparatus 700. For example, when a user wants to cut into a single side of a bag rather than both sides of a bag, she can detract the retractable stops (715 and 716). When a user wishes to cut through a thicker bag or other piece of material, she can retract the stops (715 and 716) to expose a larger depth of the blade. Moreover, the user could retract the first stop 715 and detract the second stop 716, then flip the second arm (not shown) over to use the blade as a box cutter. When the second arm is flipped over the first arm 705, it is contemplated that the outer portion of the first arm 719 will directly face an outer portion of the second arm (not shown).

Figure 8:
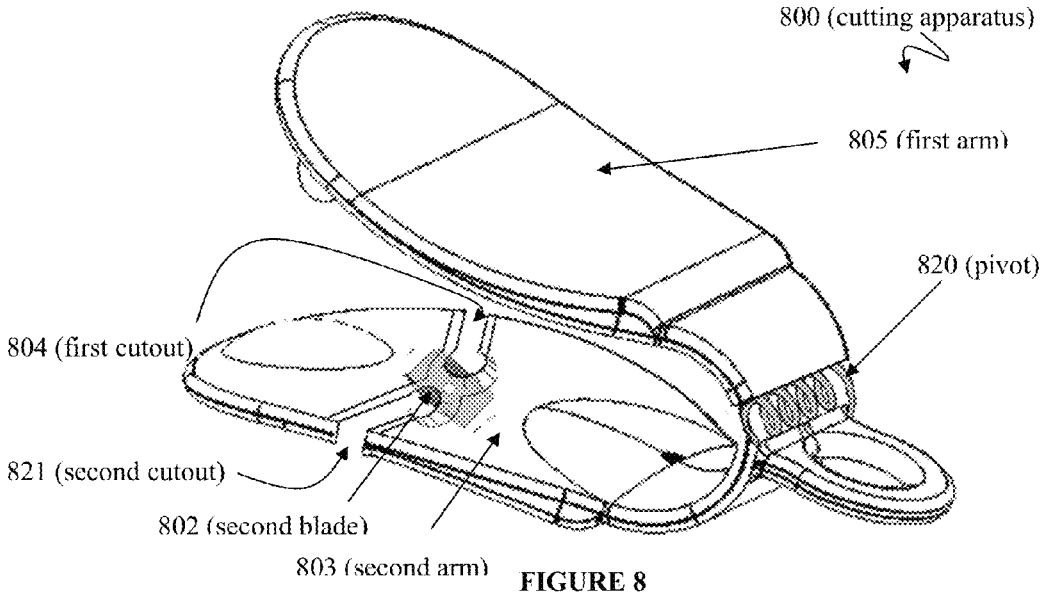
FIG. 8 is a side-perspective view of a cutting apparatus having two cutouts sharing a blade.

In FIG. 8, a cutting apparatus 800 comprises a first arm 805 that is contiguous with a second arm 803 at a pivot 820. Cutting apparatus 800 generally comprises a first arm 805 and a distinct second arm 803, which are each coupled to a pivot 820 (e.g. a hinge). As used herein, a "pivot" means any piece(s) of material or materials that couple one arm with another arm, such as a hinge, a spring, or piece(s) of plastic.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In embodiments such as the one shown on FIG. 8, it is contemplated that the first arm 805 could comprise one type of material, the second arm 803 could comprise a different type of material, and the pivot 820 could comprise yet another different type of material. Alternatively, the first arm 805, the second arm 803, and the pivot 820 could have at least one type of material in common.

Apparatus 800 comprises a second arm 803 having a first cutout 804 and second cutout 821 sharing a second blade 802. First and second cutouts can be located on either the same arm or different arm as first blade (not shown but on first arm 805). Moreover, first and second cutouts can be located on any portions along an arm. They can be located near middle portions of second arm, as shown in FIG. 8, or be located near the front of second arm, as shown in FIG. 9.

Figure 9:
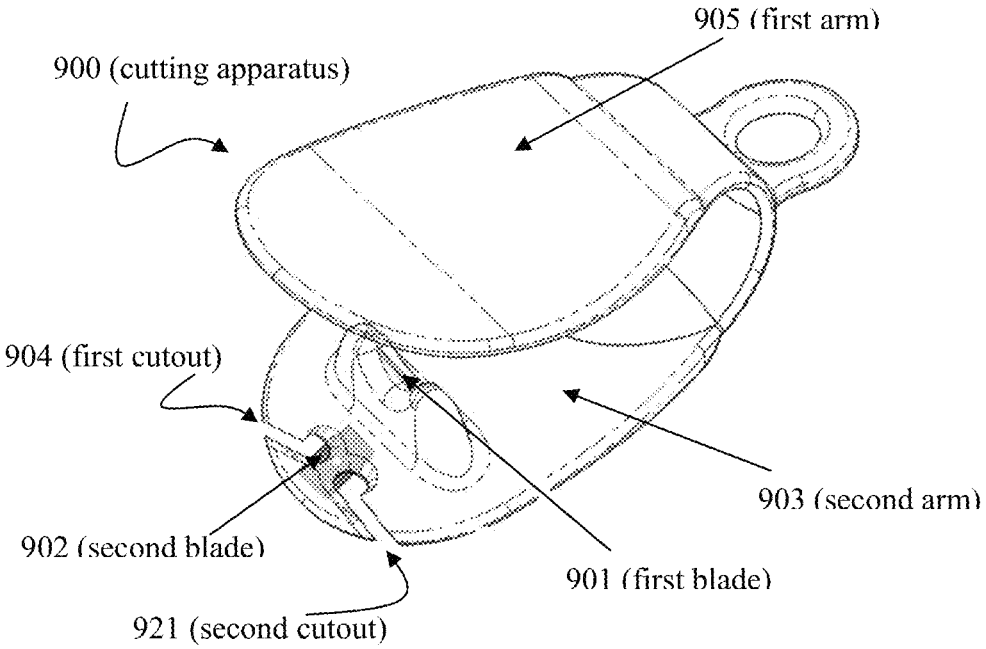
FIG. 9 is a top-perspective view of another cutting apparatus having two cutouts sharing a blade.

In FIG. 9, first and second cutouts 904 and 921, and second blade 902 of apparatus 900, are located on second arm 903 in front of first blade 901. First arm 905 can comprise a first raised portion and/or second raised portion (not shown) that is at least partially juxtaposable against blade 901. Alternatively, a flat, inner portion (not shown) of first arm 905 can act as the cutting surface.

Figure 10:
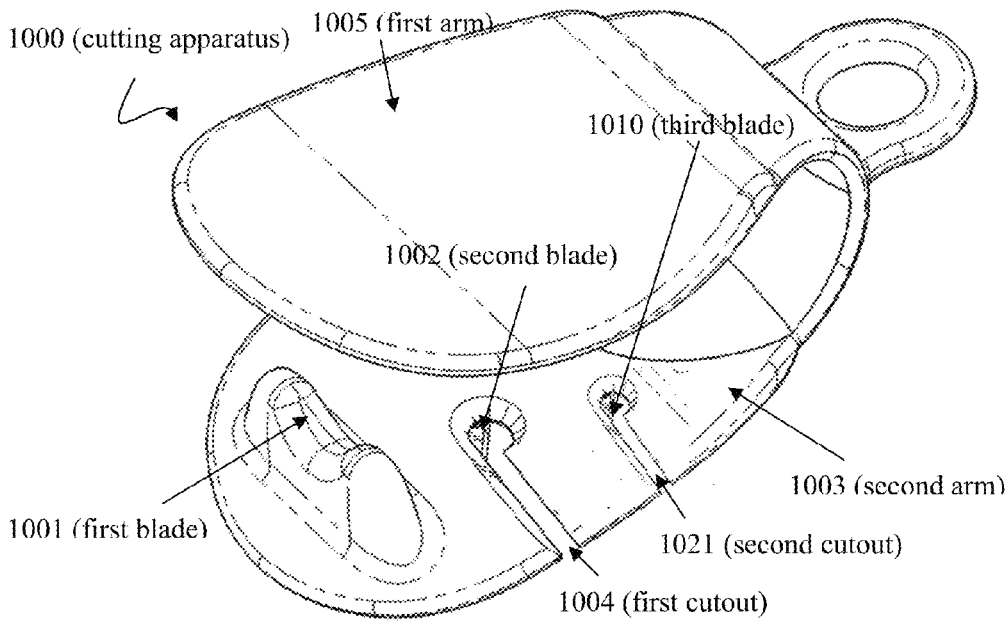
FIG. 10 is a top-perspective view of a cutting apparatus having two cutouts.

FIG. 10 shown an alternative embodiment of a cutting apparatus 1000 having some aspects of the inventive subject matter. Apparatus 1000 has a first arm 1005 having a cutting surface that is partially juxtaposable against first blade 1001 of second arm 1003. Second arm 1003 further comprises first cutout 1004 exposing a second blade 1002, and second cutout 1021 exposing a third blade 1010. In such configurations, second blade 1002 and third blade 1010 are generally not juxtaposable against a cutting surface of an arm.

Figure 11A:
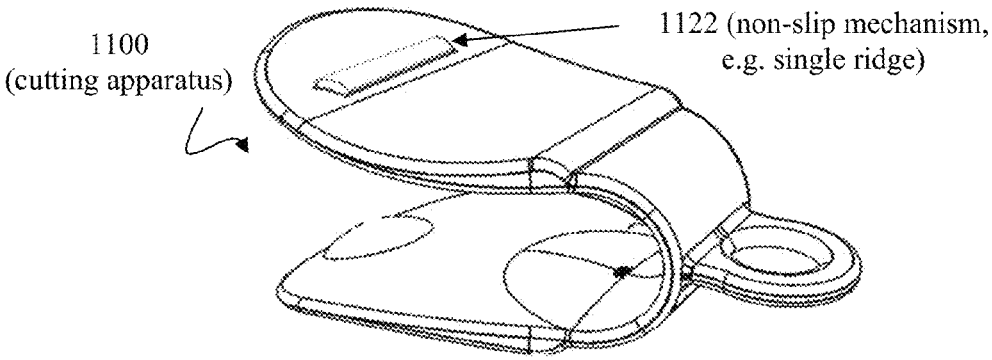
FIG. 11A is a side perspective view of a cutting apparatus having a slip prevention ridge.
Figure 11B:
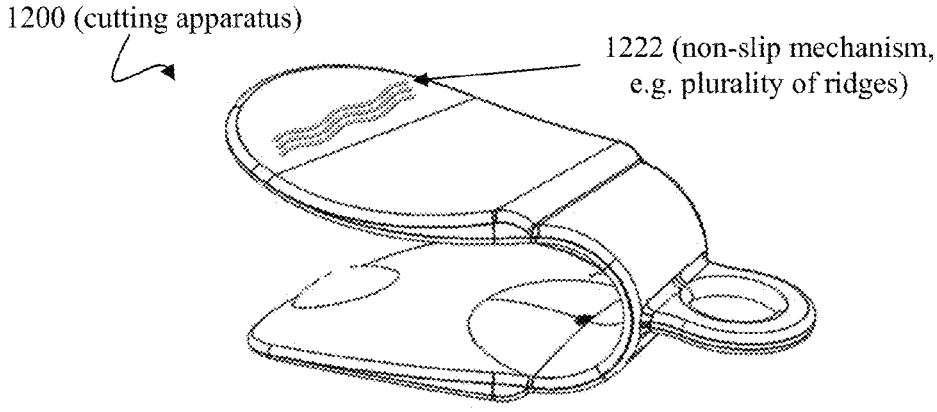
FIG. 11B is a side perspective view of a cutting apparatus having another slip prevention ridge.
Figure 11C:
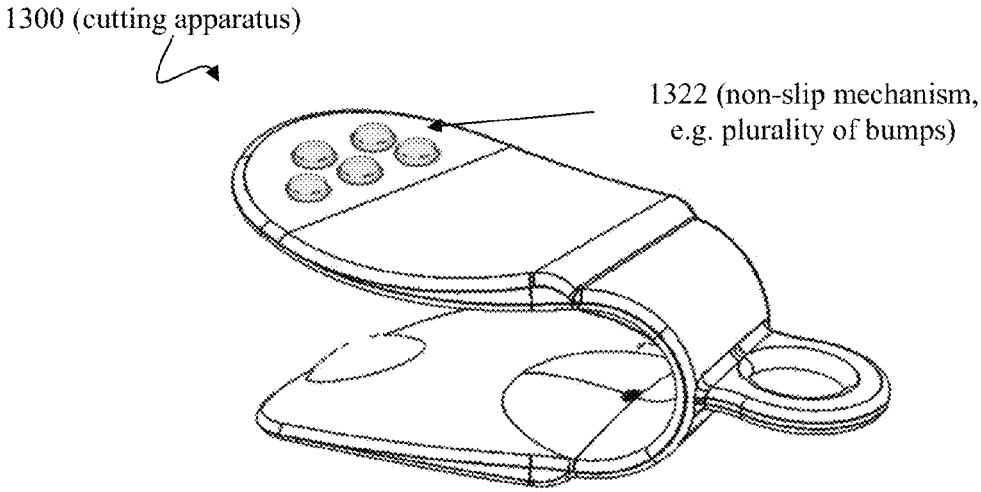
FIG. 11C is a side perspective view of a cutting apparatus having yet another slip prevention ridge.

In FIGS. 11A-C, a cutting apparatus, e.g. 1100, 1200, and 1300, can comprise a non-slip mechanism, such as a single ridge 1122, a plurality of ridges 1222, or a plurality of bumps 1322. Such ridges and bumps could be useful to stop a user's fingers from slipping off the apparatus while in use. Other contemplated embodiments could include a piece of a rubber or other non-slip material, a dent configured to accept a finger, or any other suitable measure to prevent slippage during use. It is contemplated that a non-slip mechanism can be located on any outer portion of the cutting apparatus.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A dual cutting apparatus comprising:

a first arm continuous with a second arm;

a first blade comprising an edge, wherein the edge has a first end, a second end and a central portion;

a first cutter coupled to the first arm, wherein the first arm partially encloses the first blade at the first end and the second end in a manner that exposes at least a segment of the central portion of the edge of the first blade, wherein portions of the first arm partially enclosing the first end and the second end project beyond the central portion, and wherein the central portion is operable in conjunction with a juxtaposable first raised portion of the second arm; and a second cutter coupled to at least one of the first and second arms, wherein the second cutter is distinct from the first cutter and comprises a second blade.

2. The apparatus of claim 1, further comprising a cutout, and wherein the second blade is within the cutout, and wherein the cutout and the second blade compose the second cutter.

3. The apparatus of claim 1, wherein the second arm further comprises a first anvil.

4. The apparatus of claim 3, further comprising a second raised portion.

5. The apparatus of claim 4, further comprising a third blade.

6. The apparatus of claim 3, wherein the first blade is configured to make a cut in a work piece when used in conjunction with the first raised portion of the second arm.

7. The apparatus of claim 4, wherein the central portion includes first and second exposed portions, and wherein the first blade is configured to make a cut in a work piece when used in conjunction with the first and second raised portions.

8. The apparatus of claim 5, wherein the first blade is configured to make a cut in a work piece when used in conjunction with the first raised portion and the third blade is operable in conjunction with the second raised portion.

9. The apparatus of claim 1, wherein the first cutter is continuous with the first arm.

10. The apparatus of claim 1, wherein the first blade is at least partially embedded in the first arm.

11. The apparatus of claim 1, wherein the second arm is a base.

12. The apparatus of claim 1, wherein at least a portion of the first blade comprises steel.

13. The apparatus of claim 1, wherein at least a portion of the first blade comprises ceramic.

14. The apparatus of claim 1, wherein at least a portion of the first blade comprises plastic.

15. The apparatus of claim 1, wherein at least a portion of the first blade is coated with polytetrafluoroethylene.

16. The apparatus of claim 1, further comprising a locking strap configured to lock the first cutter and the second arm in a first position.

17. A dual cutting apparatus comprising:

a first arm and an opposable second arm;

a first blade comprising an edge, wherein the edge has a first end, a second end and a central portion;

the first arm partially enclosing the first blade at the first end and the second end in a manner that exposes at least a segment of the central portion of the edge of the first blade, and wherein portions of the first arm partially enclosing the first end and the second end project beyond the central portion;

wherein the second arm comprises a raised portion that is juxtaposable against the central portion of the edge of the first blade; and wherein at least one of the first arm and the second arm comprises a first cutout comprising a second blade.

18. The apparatus of claim 17, wherein the first arm is contiguous with the second arm at a pivot.

19. The apparatus of claim 17, wherein the raised portion comprises an anvil.

20. The apparatus of claim 19, wherein the anvil is a blade.

21. The apparatus of claim 19, wherein the anvil is completely embedded within the raised portion.

22. The apparatus of claim 19, wherein the anvil is partially embedded within the raised portion and partially exposed.

23. The apparatus of claim 17, further comprising a first retractable stop at a first portion of the first arm touching the first end.

24. The apparatus of claim 23, further comprising a second retractable stop at a second portion of the first arm touching the second end.

25. The apparatus of claim 17, wherein the first arm is a base.

26. The apparatus of claim 17, wherein the second arm is a base.

27. The apparatus of claim 17, wherein the second blade is at an innermost portion of the cutout.

28. The apparatus of claim 17, wherein the first cutout is within the second arm.

29. The apparatus of claim 17, wherein the first cutout is within the first arm.

30. The apparatus of claim 17 wherein at least one of the first arm and the second arm further comprises a second cutout comprising the second blade.

31. The apparatus of claim 17 wherein at least one of the first arm and the second arm further comprises a second cutout comprising a third blade.

* * * * *